US006640511B1

(12) United States Patent
Link

(10) Patent No.: US 6,640,511 B1
(45) Date of Patent: Nov. 4, 2003

(54) ANCHOR PLATES

(75) Inventor: Roger Vernon Rufus Link, Knutsford (GB)

(73) Assignee: Valro Manufacturing Limited, Knutsford (GB)

( * ) Notice: Subject to any disclaimer, the term of this patent is extended or adjusted under 35 U.S.C. 154(b) by 0 days.

(21) Appl. No.: 09/641,051

(22) Filed: Aug. 17, 2000

(51) Int. Cl.[7] ..... E04D 5/14; E04D 11/02
(52) U.S. Cl. ..... 52/410; 52/745.21
(58) Field of Search ..... 52/408, 410, 745.21, 52/746.11; 411/531; 156/71

(56) References Cited

U.S. PATENT DOCUMENTS 3,562,054 A 2/1971 Wolf
4,732,412 A * 3/1988 Van Der Linden et al. . 428/349
4,841,706 A * 6/1989 Resan ..... 52/410
4,852,323 A * 8/1989 Kartfilt ..... 52/410
4,907,927 A 3/1990 Choiniere
4,977,720 A 12/1990 Kuipers
5,018,329 A * 5/1991 Hasan et al. ..... 52/410
5,082,412 A 1/1992 Thomas
5,803,693 A * 9/1998 Choiniere et al. ..... 52/410

FOREIGN PATENT DOCUMENTS

DE 198 03 045 8/1999
WO WO 96 31670 10/1996

* cited by examiner

*Primary Examiner*—Michael Safavi
(74) *Attorney, Agent, or Firm*—Barlow, Josephs & Holmes, Ltd.

(57) ABSTRACT

An anchor plate for securing a membrane to a sub-structure such as a roof, tunnel, tank etc. The plate has an elevated bonding platform and a enlarged central countersink, sufficiently deep to accommodate the head of a fastening screw, without the screw head protruding above the top profile of the anchor plate when the screw secures the plate to the underlying substructure. The height difference between the bonding platform and the base of the countersink together with the fact that the countersink area is wider than the head of the screw ensures that when the screw is fastened to the underlying substructure, the bonding platform does not flex. The bonding platform carries a heat activated adhesive which is inductively heated to secure an overlying membrane to the substructure.

3 Claims, 19 Drawing Sheets

SECTION X-X

ANCHOR PLATES

BACKGROUND OF THE INVENTION

The present invention relates to anchor plates for use in anchoring waterproof roofing membranes.

Waterproof membranes are commonly used in the construction industry to cover roofs or line tunnels, swimming pools, tanks, waste pits and the like. When a membrane is laid down onto a surface, for the purpose of providing a waterproof covering, it is necessary to anchor the membrane to the surface to prevent it falling off or blowing off in the wind. For example, in a tunnel, the membrane is fixed to the inside of the tunnel rock walls and roof by anchors, and the concrete tunnel lining is applied over the membrane. The membrane prevents natural ground water from seeping through the concrete tunnel lining. On a roof, the membrane is held down by anchors fixed into the steel, concrete or wood substructure of the roof.

The anchor can take many forms, but the most important feature is not to exceed the point loading that will destroy the membrane during the anticipated maximum load conditions. These loading parameters are defined by national regulatory testing requirements, such as Factory Mutual in USA and LGA Tests in Europe. The way to reduce point loading is to use a number of anchors with a large attachment area, or many small area anchors spread evenly over the attachment area. This finally comes down to cost, either of the anchor itself, or of the labor to perform the attachment.

One form of known anchor is that shown in FIG. 1, in which a plastic or rubber pad 5, has been factory loaded with metallic granules in a suitable annular area 1. The top surface of the metallic loaded area is factory coated with a suitable adhesive 2 that will bond the pad to the underside of the membrane 3, when the adhesive is heated. A smaller plastic disc 4 is placed centrally over the pad 5 and is secured to the substructure 6 by means of a fixing device 7 (screw, nail, etc), passing through the center of the plastic disc 4. The substructure 6 may be covered with a layer of insulation 8. In use, an induction heater is applied above the membrane 3 to heat the metallic granules 1, which in turn heats the adhesive 2 thereby bonding the membrane 3 to the pad 5.

The benefits of this form of anchor are that the central fixing device 7 can be applied without due consideration of the small disc 4 becoming concave, due to being overdriven. Also, the flexible nature of the pad 5 allows the adhesive bond to flex and hence remain in the shear mode, so producing a far greater holding force.

The disadvantage is that it is more costly than other anchor systems. Furthermore, the membrane 3 is not fixed directly to the disc 4 therefore it may flap in the wind and variations in ambient temperature which cause the membrane 3 to shrink and expand can cause damage to the pad 5, where the fixing device 7 passes through, causing failure of the pad 5 by tearing. A further problem exists if the surface under the pad 5 is not uniformly flat, in that the heating of the metallic granules 1 will be uneven, causing a failure potential.

FIG. 2 shows another form of known anchor plate comprising a steel plate 9 which has a factory bonded layer of membrane material 10 on its upper surface. This anchor plate is fixed to the substructure 6 by a fixing device 7 which passes through the center of the anchor plate. The anchor plate 9 has a countersink 14 in the center to accommodate the head of the fixing device 7, so that the top profile of the anchor plate, over the surface of the membrane material 10 is totally flat with the top of the fixing device 7 in place. The substructure 6 may be covered with an insulating layer 8. The overlying membrane 3 is secured to the anchor by means of applying a solvent 12 to the upper surface of the material 10 and then quickly applying pressure to top of the membrane 3 to initiate the bonding procedure.

The benefits of this anchor system is that it is simple and low cost and it anchors the membrane 3 securely to the substructure 6.

The disadvantages are that the solvent application is very unhealthy for the operator and if the fixing device 7 is overdriven, the anchor plate will become concave. This both weakens it for vertical wind loading and makes it difficult to obtain a uniform bond with the solvent, unless the membrane 3 is held down into the concavity until the solvent sets.

A simple new anchor system was required to overcome these difficulties, especially the solvent use.

EP 0735210 describes a disc very similar to FIG. 2, but without the factory bonded membrane material as shown in FIG. 3. A steel anchor plate 9 has a countersink 14 in the center to accommodate the head of the fixing device 7 so that the top profile of the anchor plate is totally flat with the top of the fixing device 7 in place. The thickness of the steel anchor plate 9 was increased until the top surface would not become concave if the fixing device 7 was overdriven. The anchor plate is fixed to the substructure by the fixing device 7. The substructure may be covered by a layer of insulation 8. The top surface of the anchor plate 9 is factory coated with a suitable heat activated adhesive 13. The induction heater is applied above the membrane 3 and is used to heat the steel anchor plate 9 which in turn heats the adhesive 13 which then bonds the steel anchor plate 9 to the membrane 3.

The benefit of this anchor plate is its simplicity.

The main disadvantage of this plate is that even when the steel thickness is substantial, the top surface of the plate still becomes slightly concave when the fixing device 7 is overdriven. The reason being that the countersink 14 part of the plate has to be driven down into the insulation layer 8, so that the bottom surface of the anchor plate sits on the surface of the insulation layer 8. Further disadvantages are that the increased thickness of the steel increases the cost of the anchor plate and the considerable thickness of the steel requires much more heat time from the induction heater, resulting in increased costs. Another disadvantage of this design is that it cannot be used in applications where there is no insulation layer to accept the countersink part of the anchor plate.

SUMMARY OF THE INVENTION

It is thus an object of the present invention to provide an anchor plate which overcomes or alleviates the drawback of the known anchor plates.

In accordance with one aspect of the present invention there is provided an anchor plate for securing a membrane to a structure, the plate comprising a first part for receiving a fastener for connecting the plate to the structure and which has a fastening area which contacts the structure and a second part which is elevated with respect to the fastening area for contacting the membrane and which second part carries a heat activated adhesive.

This has the advantage that when the plate is secured to a structure, the height difference between the bonding area and the fastening area leads to a reduction in the force applied to the bonding area when a fastener is inserted into the plate in order to secure the plate to the structure, with a consequent reduction in the distortion of the bonding area allowing the bonding area to retain its proper shape for its intended use. The increased strength of the plate structure leads to a reduction in the amount of material required for its construction with a consequential reduction in unit cost. Also, because the plate is more visible when covered by a membrane, this allows its easier location for heat activation of the adhesive.

Preferably, the first part has a substantially planar base for contacting the support. The planar undersurface of the fastening part leads to a stable support for the anchor plate to sit on in the event that the plate is mounted to a solid substructure, further reducing the curvature of the upper bonding surface.

Preferably, the first part is flexible. This allows the support contacting surface to more readily adapt to the profile of a non-uniform support, further reducing distortion to the plates bonding area and also providing tactile feedback to the user which prevents overdriving of the plate into a less solid surface, such as an insulating layer.

In a preferred embodiment the first part is an insert. This has the advantage that a variety of fastening means can be used with a particular plate design by simply inserting the insert which is adapted to receive the desired fastening device. Thereby manufacturing costs are reduced because only one set of tooling is required to produce the plate rather than a plurality of tooling adapted to produce a respective plurality of plates each with means to receive a different fastener.

The insert may be a plastics disc. This has the advantage that it is relatively cheap to make alternative plastics inserts to receive the head shape of any required fastener. If the anchor plate is used in a cold climate and the fastener passes through an insulation layer into a warm moist environment below the substructure, the fastener can lose heat to the atmosphere, which causes moisture to condense on the fastener and corrosion to set in, ultimately resulting in failure. The plastics insert has the advantage that it provides a high degree of thermal insulation for the fastener and thereby reduces corrosion and potential failure thereof.

The second part is elevated with respect to the fastening area and the insert may fill the void within the bonding area. This has the advantage that this prevents the membrane sinking down onto the head of the fastener and forming a depression that traps dirt and rain water. The load carrying limit of the plate is set by the force that fixes the fastener in place. The insert provides a larger quantity of material about the fastener's head further reducing stress during insertion of the fastener and allowing a greater load carrying limit for the plate.

Preferably the first part is corrugated. This has the advantage of strengthening the fastening area, thereby better absorbing the fastening force and reducing any distortion in use extending to the elevated bonding area.

Preferably, the first part comprises a raised area providing a countersink for receiving a fastener.

Preferably, the first part comprises a central opening for receiving a fastener and the second part is annular and coaxial with said opening.

Preferably, the first part carries a heat activated adhesive. This has the advantage that in use the fastener can be secured by the plate, when the membrane is bonded to the plates second part.

In a preferred embodiment the plate includes at least one third part forming a support for the plate, the second part being elevated with respect to the third part and the third part being remote from the first part. This has the advantage that the plate can be more securely balanced on an underlying structure, reducing tilting of the plate in use if an edge thereof is trodden on. Furthermore the support increases the rigidity of the second part reducing the influence of wind, if for example the plate is used on a roof and reducing the tendency for the plate to bend if a membrane is hung therefrom for example in a tunnel.

Also, the turned down edges provides better retention of insulation boards, with the plate both securing the overlying membrane and securing the underlying insulation boards without the need for additional fixing means. The bending of the surface also produces a smooth edge which reduces tearing of the membrane when it is pulled over the plate.

Preferably the third part has a substantially planar base, more preferably the third part's planar base is co-planar with the planar base of the first part. This facilitates the use of the plate on a planar structure.

In a preferred embodiment the third part surrounds the second part.

Preferably a frustoconical surface extends between the first and second parts and/or the second and third parts.

Preferably, the anchor plate is stamped from a sheet of steel.

Preferably, the anchor plate is non-metallic and includes metallic granules.

In accordance with a second aspect of the present invention, there is provided an anchor plate for securing a membrane to a support, the plate being coated on its side adapted to contact the support with a heat activated adhesive.

Preferably the anchor plate also comprises means for the attachment of a separate fastening means.

Preferably both sides of the plate carry a heat activated adhesive, more preferably the opposite sides of the plate carry different adhesives.

Preferably, the anchor plate is metallic.

Preferably, the anchor plate is non-metallic and includes metallic granules.

BRIEF DESCRIPTION OF THE DRAWING FIGURES

By way of example only specific embodiments of the invention will now be described with reference to the accompanying drawings, in which.

DETAILED DESCRIPTION OF THE PREFERRED EMBODIMENTS

Figure 4:
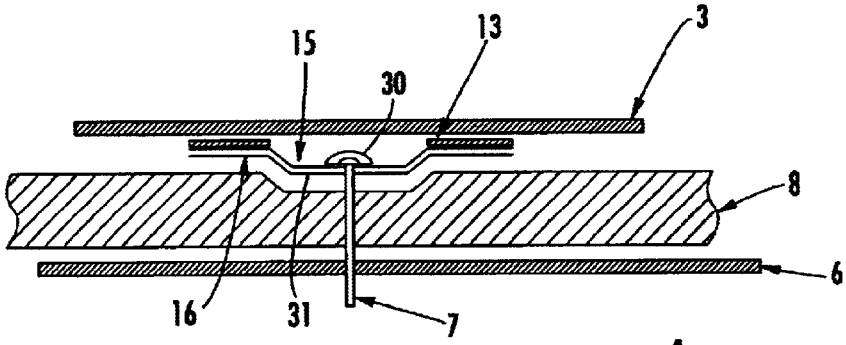
FIGS. 4 to 7 are schematic views of an anchor plate constructed in accordance with a first embodiment of the present invention, illustrating its use in securing a membrane to a substructure.

Referring to FIG. 4, to fit a plastics or rubber waterproof membrane 3 to a roof structure, a plurality of steel anchor plates 16 (one of which is illustrated in FIG. 4) are firstly screwed to a roof substructure 6 through a thermal insulation layer 8 using a fixing device 7, the top surface of each anchor plate 16 being pre-coated with a heat activated adhesive 13 which forms a bonding platform. The membrane 3 is then rolled across the roof structure and a remote electromagnetic induction heater (not illustrated) above the membrane heats up the anchor plate whereby the adhesive is activated and adheres the membrane 3 to the plate 16.

Figure 1:
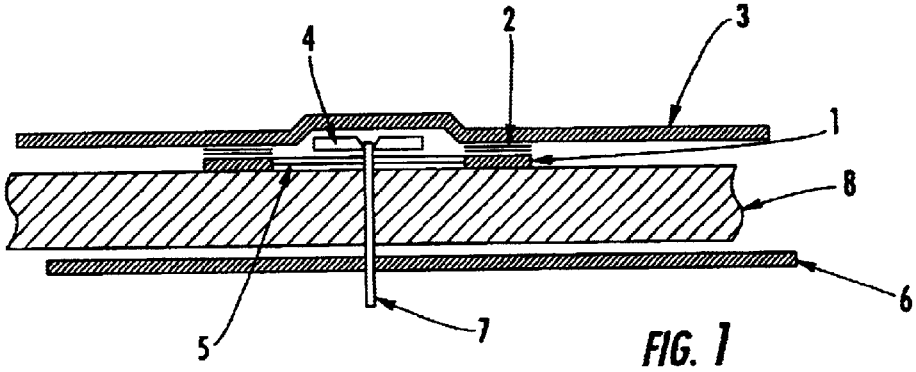
FIGS. 1 to 3 are schematic views of three known anchors illustrating their respective use to secure a membrane to a substructure.
Figure 2:
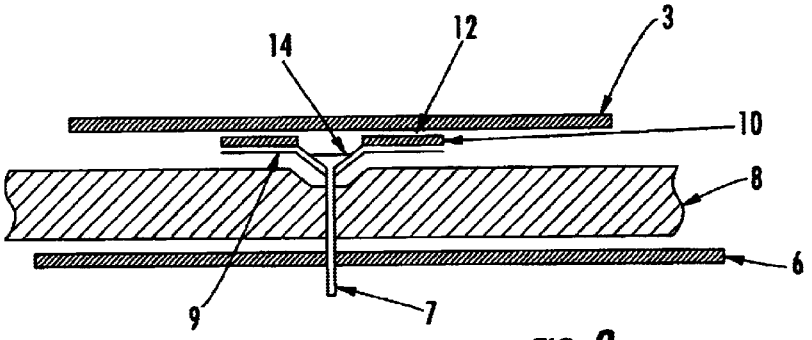
Figure 3:
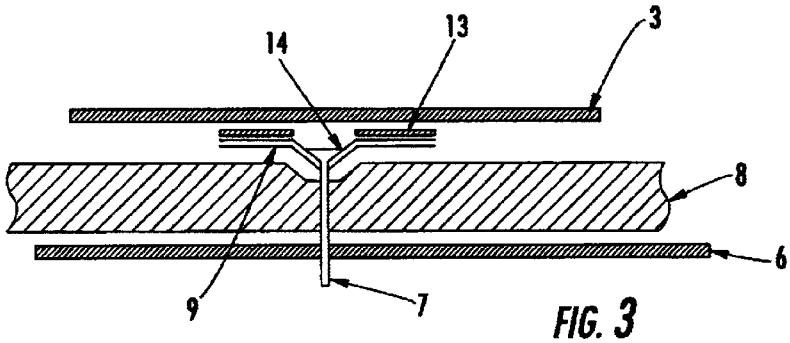

The plate of FIG. 4 differs from that of FIG. 3 in that it has a considerably, laterally enlarged central countersink 15, sufficiently deep to accommodate the head 30 of a fixing device 7, without said head 30 protruding above the top profile of the anchor plate 16 when the fixing device 7 secures the disc to the underlying structure 6, 8. The base 31 of the countersink 15 is substantially flat.

The intention behind the large flat bottomed countersink is threefold.

Figure 5:
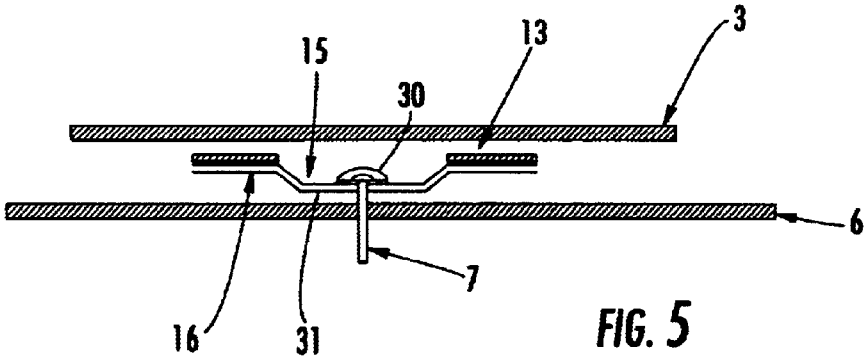

The first reason is to provide a sufficiently large flat base for the anchor plate to sit on and to be stable in the event that the anchor plate is to be mounted upon a solid substructure 6 such as wood or concrete, without an insulation layer 8. In this instance there is no tendency for the top surface of the anchor plate 16 to become concave, as shown in FIG. 5.

Figure 6:
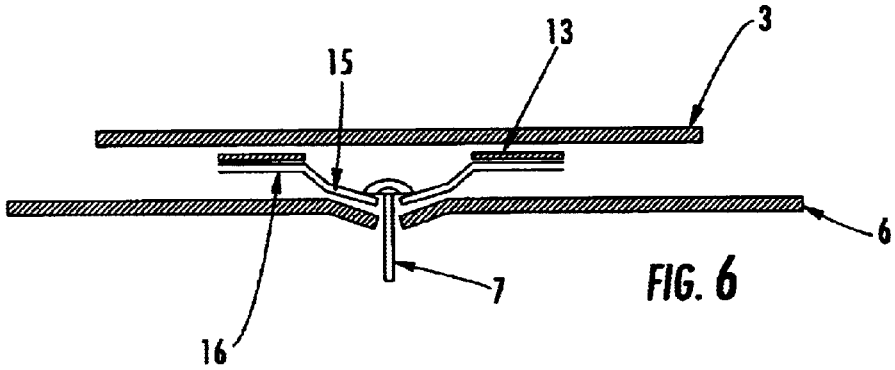
Figure 7:
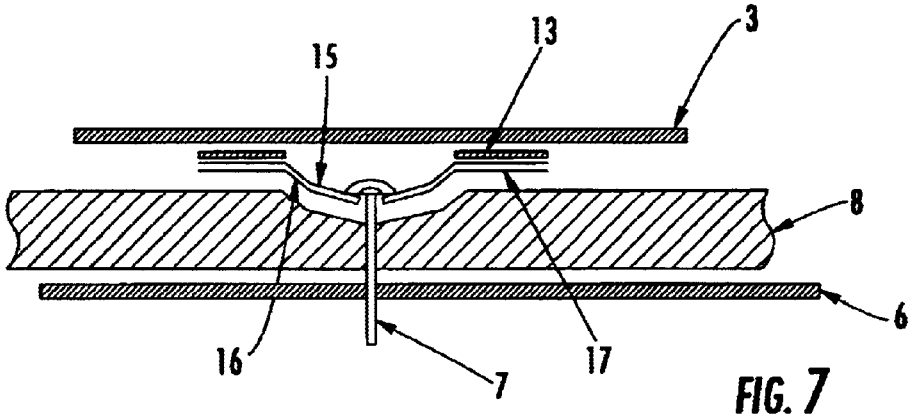

The second reason is to provide a degree of flexibility in the base to allow over driving of the fixing device 7, without making the top surface of the anchor plate concave, as shown in FIGS. 6 and 7.

The third reason, as shown in FIG. 7, is to provide a reasonable resistance against the fixing device 7 pulling the countersink 15 down into the soft insulation layer 8 prior to the underside 17 of the anchor plate touching the top of the insulation layer 8. When the fixing device 7 takes the form of a screw, the operators frequently use a motorized screwdriver to drive the screw and most frequently the operator relies on the resistance of the screw during fastening to know when the screw is fully home. This is a very unreliable method, but one which seems impossible to stop, even though most manufacturers of the motorized screw drivers provide a automatic depth stop facility. The resistance to turning of the screw is increased by the large flat base of the countersink 15, being pushed down into the insulation layer 8 by the screw. The further the screw pulls the countersink down, the greater the resistance to the turning of the screw. When the underside 17 of the anchor plate 16 touches the insulating layer 8, the screw resistance increases suddenly before making the top of the anchor plate concave, this provides the operator with tactile feedback to thereby signal disconnection of the motorized screwdriver. This allowed the thickness of the steel anchor plate 16, to be decreased slightly, compared with that of the anchor of FIG. 3; which in turn shortens the induction heating time.

The advantage of this new design is that the operator can feel when the fixing device 7 is secure without making the top of the anchor plate concave. Another advantage is that the area around the fixing device can be badly deformed without affecting the anchor plate top surface, as shown in FIG. 6.

Figure 8:
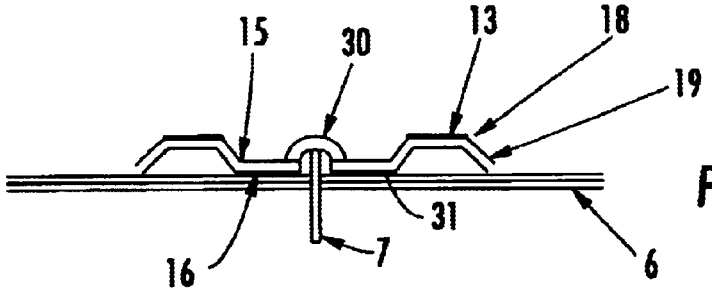
FIG. 8 is a schematic view showing a second embodiment of anchor plate.

In a second embodiment of plate, as illustrated in FIG. 8 (shown for the ease of illustration without the insulating layer), the plate of FIG. 4 is modified in that its outer peripheral edge 19 is turned downwards. This leads to an increase in the rigidity of the top surface of the plate and therefore the thickness of steel used in the manufacture of the plate can be reduced further, without compromising on plate strength. By turning the outer edge down, the flat area on the top surface of the anchor plate is reduced and therefore requires less induction heat time. Also, the turned down edge provides a smooth edge 18 for the membrane 3 to pass over, as opposed to a potentially sharp edge of a plain punched edge. Furthermore, the turned down edge makes the plate self supporting if the edge is trodden on, particularly before the membrane is applied.

In a third embodiment of anchor plate, as illustrated in FIGS. 9 and 10, shown again without the insulating layer, the plate of FIG. 8 has been modified in that the outer peripheral edge 19 is turned down at a little less radius from the center of the anchor plate, so reducing the top surface area further; with a further consequential reduction in induction heater time. The extra turned down length, so obtained terminates in an annular shoulder 20 which is substantially parallel to the upper flat surface 13 of the plate 16 and being substantially co-planer with the base 31 of the countersink. The turned down edge also reduces the possibility of wind bending the top surface of the anchor plate.

Figure 9:
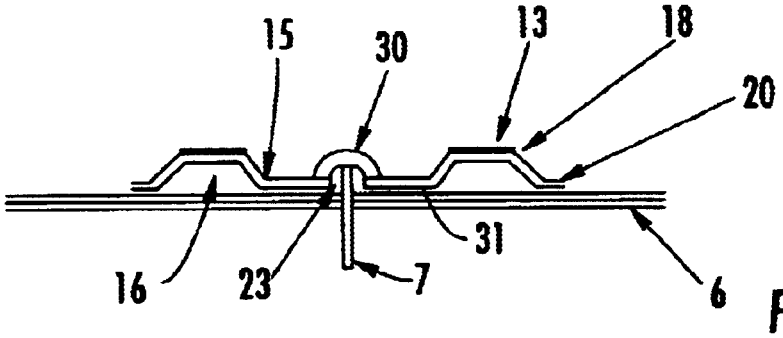
FIG. 9 is a schematic view of a third embodiment of anchor plate.

The advantages of the design of FIG. 9 are many. When the anchor plate 16 is fitted onto a rigid surface, the top surface of the anchor plate is fully supported by the inner countersink 15 and the outer shoulder 20. Walking on the anchor plate does not deform the top surface. When fixed onto soft insulation the anchor plate top surface is so rigid that it will compress and hold any uneven insulation without cutting it, this plate therefore is particularly suitable for use between two insulation blocks, which may have different heights and with the anchor plate both securing the blocks and forming a means to hold the overlying membrane in place. Moderate overdriving of the fixing device 7 does not cause deformation of the top surface of the anchor plate. The heating time is reduced to acceptable levels by the reduction of the top surface area of the anchor plate and the reduction in steel thickness of the anchor plate. Another advantage is that because the anchor plates sit proud of the surface on which they are fixed they are much easier to locate, both visually and by feel, when they are covered by the membrane 3.

Figure 10:
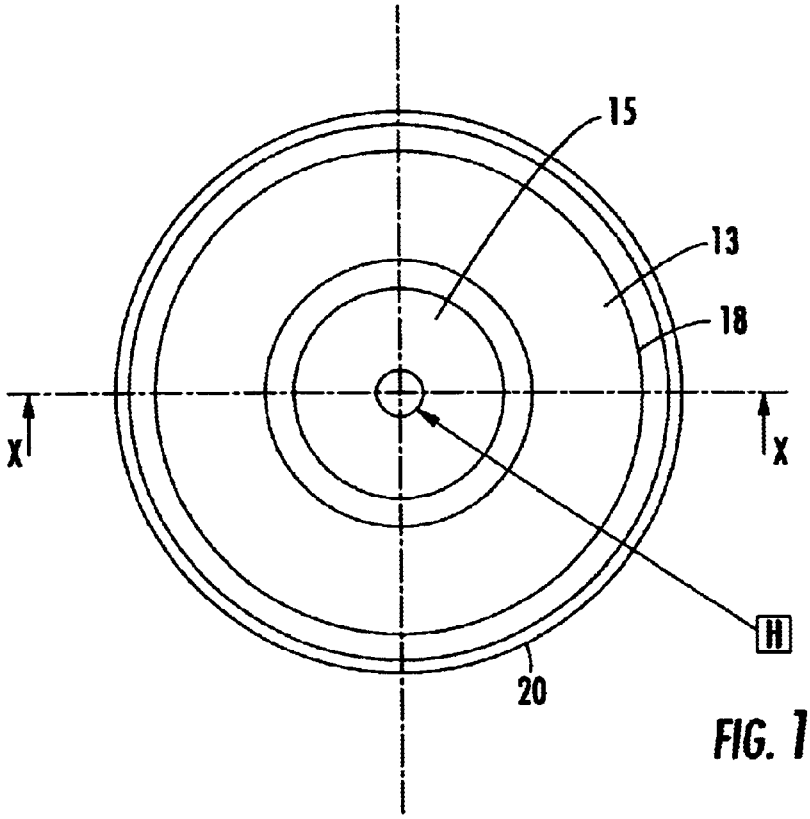
FIGS. 10 & 11 are plan view and side view respectively of the anchor plate of FIG. 9.
Figure 11:
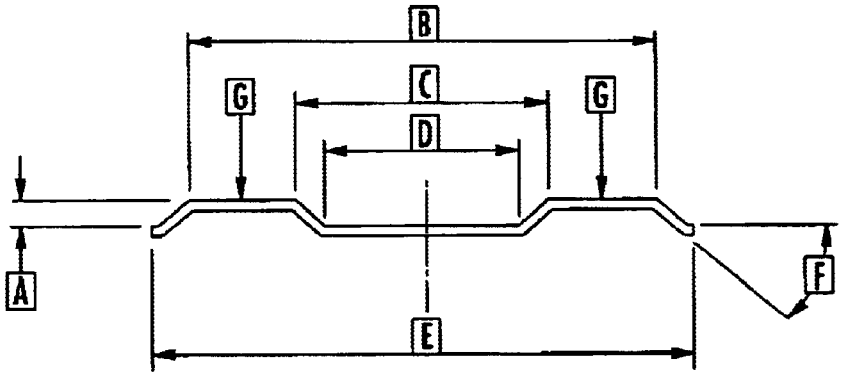

References in FIGS. 10 and 11

A=3.35 mm—depth of countersink to clear fixing head.

B=69.00 mm—outer diameter of top surface.

C=38.00 mm—inner diameter of top surface.

D=30.00 mm—insider bottom of countersink.

E=80.00 mm—overall outside diameter.

F=45.00 degrees—all sloping surfaces.

G=This top surface must be radially and laterally flat to within ±0.025 mm.

This top surface is heat activated adhesive coated—thickness 0.13 to 0.15 mm.

H=6.10 mm±0.05 mm–central fixing hole.

Material=Aluzink coated steel –0.7 mm thick ±5%.

It should be understood that the anchor plate is not restricted to the above described dimensions.

Figure 12:
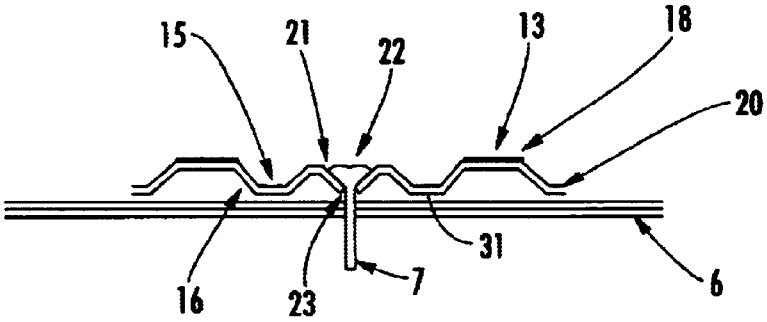
FIGS. 12, 14 to 19 are schematic views showing further embodiments respectively of the plate constructed in accordance with the present invention.
Figure 13:
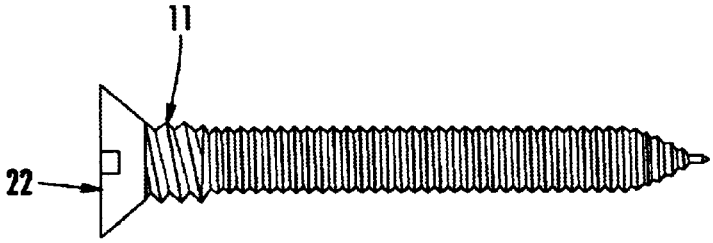
FIG. 13 is a perspective view of a fastener for use with the anchor plate.

In a further embodiment FIG. 12, the center part of the countersink is modified to accommodate different types of fixing device. Screws are currently produced that have a second coarse thread 11 immediately under the head, as shown in FIG. 13. The purpose of this thread is to lock the head into the countersink to prevent the head of the screw protruding up through the membrane when the anchor plate is pressed down into the soft insulation by someone treading on the edge of the anchor plate, so causing the membrane to be punctured. The other purpose of this thread is to prevent wind vibration from causing the screw to unwind from the substructure, with disastrous effect. Most of the currently manufactured screws with this feature have a countersunk shaped head 22. In the anchor plate design of FIG. 12 the flat base of the countersink 15 is raised up and then returned at an angle towards the center hole 23, to accept the countersunk head 22. The center hole 23 could be made to the screw manufacturer's recommended size to lock onto the thread 11. Even though the plate of FIG. 9 is illustrated as being modified, the plates of FIGS. 4, 8, 14 and 15 (described herein under) could also comprise a raised area in the base 31 of their countersink area 15 in order to accommodate the head 22 of a screw 7.

A further opportunity of locking the screw presents itself, by the application of a lower temperature heat activated adhesive into the region about the head of the screw, so that when the anchor plate is heated by the induction heater to bond the membrane, the screw head will also become bonded to the anchor plate.

Figure 15:
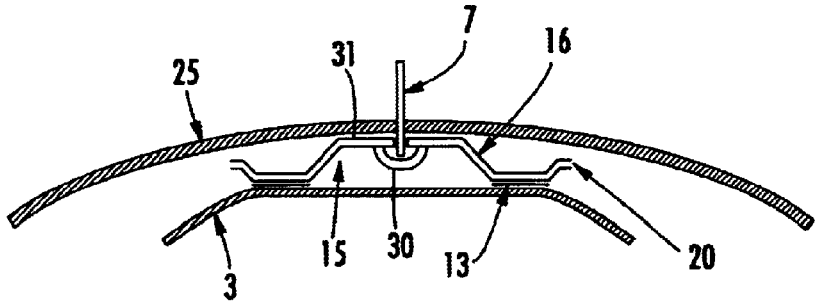

In a further embodiment as illustrated in FIG. 15, the anchor plate is further modified in order to be better adapted for fixing to curved surfaces, for example in tunnels. In this instance the countersink 15 has been deepened to allow clearance for the shoulder 20 of the anchor plate 16 with respect to the expected mounting surface curvature of an inner rock wall 25 of the tunnel, that is the shoulder 20 is not coplanar with the base 31 of the countersink 15. The base 31 of the countersink 15 is made flat as before and would flex to the curvature when being fixed by the fixing means 7 to the inner rock wall 25, without distorting the adhesive coated area 13.

Figure 14:
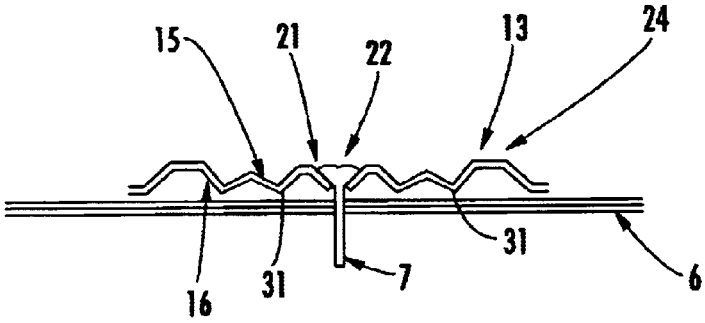

Further modifications to the anchor plates involve reducing the top surface area to the minimum possible, consistent with the strengths of the different types of adhesive 13, and the strength of the corresponding membranes in use, e.g., PVC, TPO, Rubber etc, to reduce the heat time. The top surface 24 of the anchor plate becoming a narrower ring with a slightly upward curved surface as shown in FIG. 14. The purpose of this curve is that it is much easier to make than a flat surface, but more importantly, it will roll slightly as the anchor plate is overloaded by overdriving the fixing device 7, but will always offer a laterally flat contact between the membrane and top surface of the anchor plate. The lower part of the large countersink 15, that was previously left flat, will be formed to provide additional strength, as well as the previous modifications for different fixing devices 7, as mentioned earlier.

Figure 16:
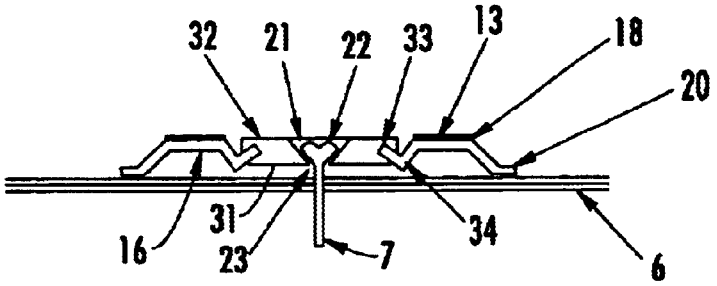

In a further embodiment as illustrated in FIG. 16, the anchor plate of FIG. 9 is further modified in that the large central countersink area 15 is not integral with the plate, it is instead omitted and replaced by a plastics insert. The peripheral edge 34 of the plate is bent upwards to form a V groove 34 and the plastics insert 32 has a corresponding groove which allows the insert to be press-fitted in the void area within the bonding platform 13. The insert 32 has a central hole and countersink 23 which allows a fixing device 7 to be inserted to connect the plate to a substructure 6, such that the head 22 of fixing device 7 is below the level of the bonding platform 13. The connection of the insert 32 to the plate via the grooves 34, 33 below the level of the bonding platform 13 ensures that when the fixing device 7 is driven the force is not transferred to the bonding platform, thereby reducing distortion of that area. Also, the strength of the material of the insert 32 about the head 22 of the screw further reduces the stress, whilst the insert is firmly held in the plate due to the fact that the circumference of the insert is many times greater than that of the head 22 of the fixing device 7. Although the plate of FIG. 9 has been modified, the plates of FIGS. 4, 8, 14 and 15 could also comprise such an insert.

Although the plate has been described as being of metal, the plate could be made of plastics or rubber and include metallic granules or the like material which radiates heat to the adhesive. Although the plate has been described as comprising an annular depression the outer profile of the plate could be more uniform, with the enlarged countersink, for instance, retained in a lightweight or hollow exterior which carries the bonding adhesive. Although adhesive has been described on one side of the plate, it could be provided on both sides, to further secure or to dispense with a separate fastening means. Although a substantially circular plate having a central fixing point has been described, the plate could have other shapes and the fixing point or points could be at a noncentral location of the plate.

Figure 19:
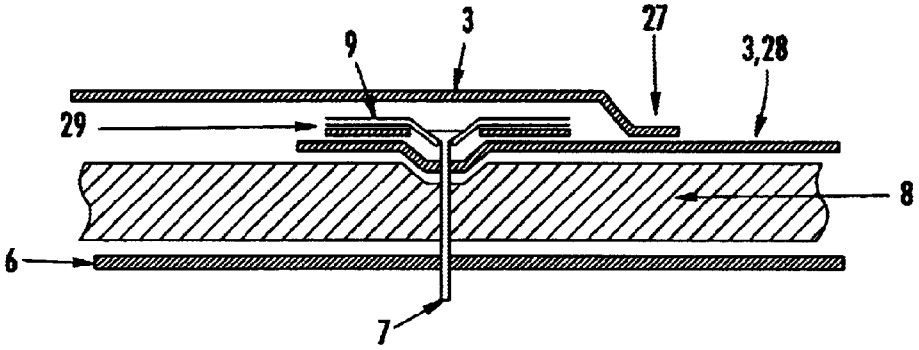

Another design of anchor plate can be used for existing methods of installation as shown in FIG. 19. The current method of applying roofing membranes by the so-called "Overlap System" is similar to FIG. 19 except there is no heat activated adhesive 29 under the anchor plate 9 and factory punched spikes face downwards from the anchor plate to penetrate the lower membrane 3, to prevent it tearing out from under the anchor plate 9, under wind loading. The covering membrane 3 is hot air welded to the lower membrane 3 at the point 27.

The major failure mode is that the spikes also help to tear the lower membrane 3, because the clamping effect of the plate 9 is very quickly reduced due to the soft nature of the insulation layer 8.

By removing the spikes and providing a factory coating of heat activated adhesive 29, on the underside of the anchor plate 9, as shown in FIG. 19, the anchor plate 9 will become permanently bonded to the lower membrane 3, after the application of heat from the induction heater from above the covering membrane 3 and located directly above the anchor plate 9. The advantage is that the roof will be far stronger and fewer anchor plates can be used.

Figure 17:
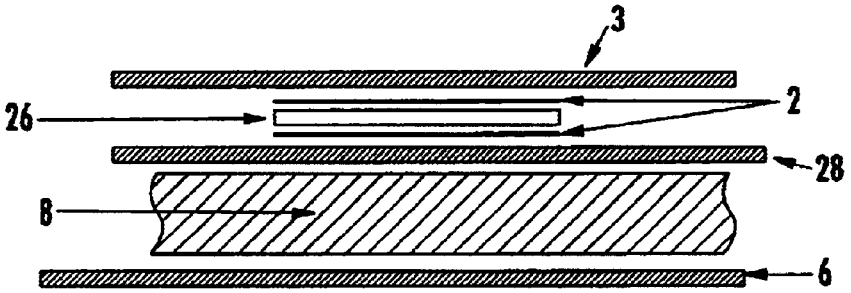
Figure 18:
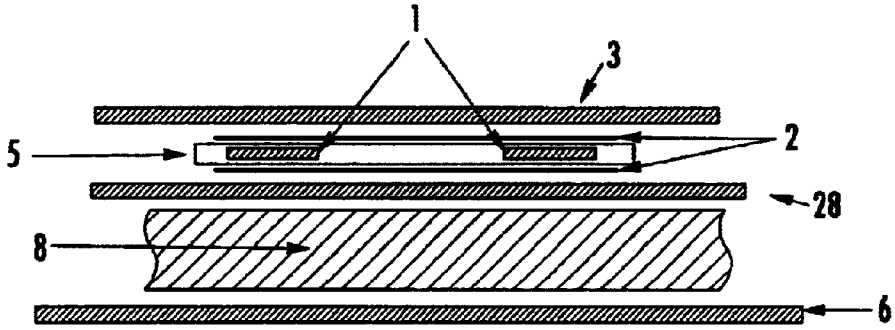

A further design of membrane anchor plate is available for instances where the existing surface is secure, stable and is suitable for direct bonding, such as re-roofing an existing roof. These options are shown in FIGS. 17 and 18 where there is no direct fixing device and fixing is accomplished by having factory coated heat activated adhesive 2 on both sides of a plate. The adhesive 2 can be of one type on top and another type underneath to match the different materials of the surface 28 to the required membrane 3. There may or may not be any insulation layer 8, or any substrate 6. There are two options for the plate, namely a metallic flat plate 26, as shown in FIG. 17, or a plastic or rubber membrane 5 can be used, which has an internal annular loading of metallic granules 1 as shown in FIG. 18. The adhesive on both sides of the plate 26 or 5 is simultaneously activated by the application of the induction heater on top of the membrane 3, located directly over the plate.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An anchor device for securing a membrane material to a structure comprising:

a disc assembly including a planar outer ring, and a flexible planar insert centrally received within the planar outer ring and being recessed within and substantially parallel relative to said outer planar ring, said insert having an outer peripheral edge overlapping an inner peripheral edge of said planar outer ring, said insert having an aperture therein;

a fastener extending through said aperture in said insert; and heat activated adhesive-disposed on an upper surface of said planar outer ring.

2. The anchor device of claim 1, wherein said insert is a plastic disc.

3. The anchor device of claim 1, wherein said insert and said planar outer ring includes mating formations, said mating formations being received in snap-fit engagement, an upper surface of said insert being recessed relative to said upper surface of said outer ring.

* * * * *